United States Patent [19]

Hoffmann

[11] Patent Number: 5,046,932

[45] Date of Patent: Sep. 10, 1991

[54] ROTARY EPITROCHOIDAL COMPRESSOR

[75] Inventor: Ralph M. Hoffmann, Eden Prairie, Minn.

[73] Assignee: Compression Technologies, Inc., Eden Prairie, Minn.

[21] Appl. No.: 437,889

[22] Filed: Nov. 17, 1989

[51] Int. Cl.[5] ..... F04C 18/10; F04C 29/08

[52] U.S. Cl. ..... 418/14; 418/101; 418/166

[58] Field of Search ..... 418/8, 14, 61.3, 101, 418/181, 188, 166, 168, 171; 417/243

[56] References Cited

U.S. PATENT DOCUMENTS

| | | | |
|---|---|---|---|
| 2,053,919 | 9/1936 | Pigott | 418/168 |
| 2,302,907 | 11/1942 | Eilers | 418/171 |
| 3,367,275 | 2/1968 | Workman | 418/171 |
| 4,233,003 | 11/1980 | Jeng | 418/8 |
| 4,714,417 | 12/1987 | Wankel | 418/166 |
| 4,781,542 | 11/1988 | Ozu et al. | 418/188 |

FOREIGN PATENT DOCUMENTS

| | | | |
|---|---|---|---|
| 20406 | of 1929 | Australia | 418/166 |
| 404846 | 1/1934 | United Kingdom | 418/171 |

*Primary Examiner*—Leonard E. Smith, Jr.
*Assistant Examiner*—David L. Cavanaugh
*Attorney, Agent, or Firm*—Hill, Van Santen, Steadman & Simpson

[57] ABSTRACT

In an epitrochoidal rotary air compressor, a stationary portion includes a stationary single offset power shaft on which is mounted an epitrochoidal rotor in a rotary housing portion. The rotor includes a pinion gear which cooperates with a ring gear in the rotary housing portion to move the rotor within the rotor chamber in the rotary housing portion. A centrifugally driven lubrication system including lubrication channels extending internally of the stationary power shaft is provided for lubricated bearings and gears within the apparatus. An improved compression seal engaging the lateral faces of the rotor has a plurality of buttons biasing a split ring against the lateral faces of the rotor. An air pressure unloader valve is centrifugally operated to release the load from the compressor during startup. A rotary after-cooler in the rotary housing portion removes thermal energy from the compressed air prior to leaving the compressor and an inter-cooler may be provided in a two stage compressor.

13 Claims, 7 Drawing Sheets

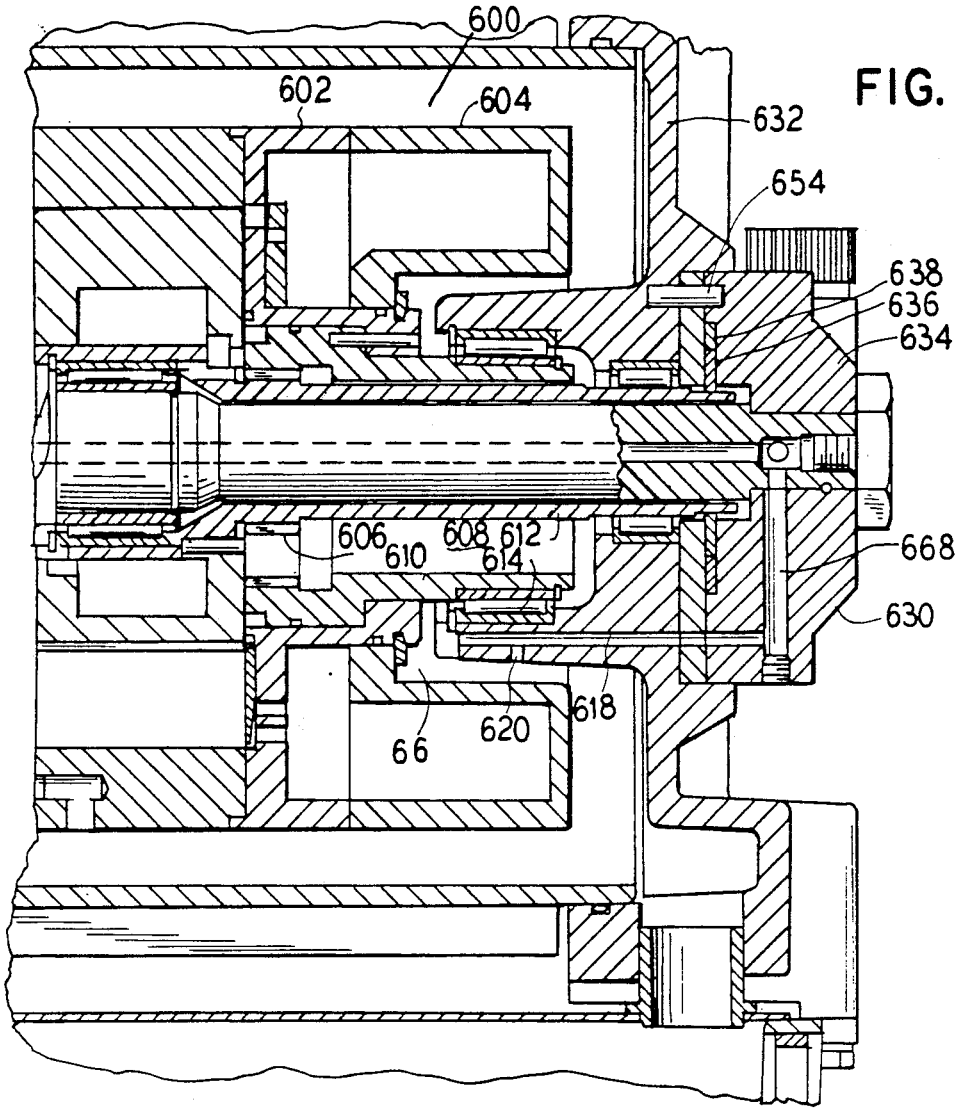
FIG. 13
FIG. 14
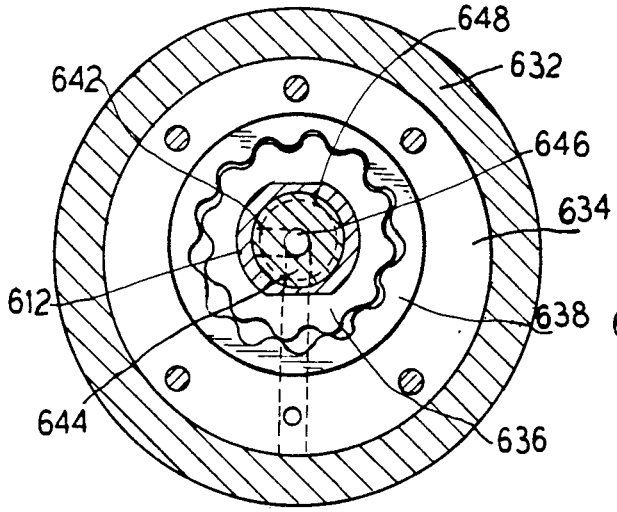
FIG. 15
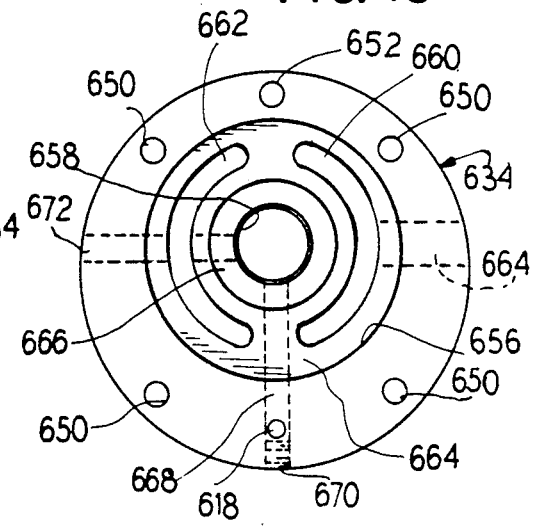

ROTARY EPITROCHOIDAL COMPRESSOR

BACKGROUND OF THE INVENTION

The present invention relates generally to a epitrochoidal rotary device and, more particularly, to an outer envelope epitrochoidal air compressor.

Rotary epitrochoidal devices are known generally in a variety of forms. Some function as prime movers while others are driven by prime movers to, for example, compress air. All have in common a rotor moving in a chamber rather than a reciprocating piston. For example, the Wankel et al. U.S. Pat. No. 2,988,065 discloses a rotary internal combustion engine in which a rotor moves within a lobed chamber in a housing while the rotor and housing both rotate.

West German Patent No. 25 18 737 by Lambrecht discloses a single-ended crankshaft in a rotary device. The crankshaft rotates and carries an off-balance fly wheel. A single-ended crankshaft is also disclosed in Doyer U.S. Pat. No. 3,285,189 in a motor, pump, or compressor with a piston rotatable within a housing. The crankshaft in Doyer also rotates and carries a counterweight.

The above-identified Lambrecht German patent also discloses a pinion gear and rotor in a rotary device which are keyed or connected together. A key connected rotor and pinion gear are also shown in Glenday et al. U.S. Pat. No. 3,384,055.

Lateral seals for rotors in rotary devices are known in a variety of forms. For example, Sabet U.S. Pat. No. 3,357,412 and Arai U.S. Pat. No. 4,243,233 each show split ring seals in rotary devices. Buttons holding seals in the lateral faces of a rotor are shown in Hart U.S. Pat. No. 3,930,767. A circularly moveable strip on the face of a rotor is shown in Peras U.S. Pat. No. 3,185,386.

Various lubricating systems are also known in the art for rotary devices. For example, Peras U.S. Pat. No. 3,343,526 discloses a lubrication channel in a shaft of a rotary engine. A rotor bearing lubrication system is disclosed in Corwin U.S. Pat. No. 4,477,240 for use in a rotary internal combustion engine and having a channel in an eccentric portion of a main shaft.

In the Deane U.S. Pat. No. 3,825,375 is disclosed an inner envelope epitrochoidal external combustion engine driven by high pressure gas. A valve is formed by a valve seat, bias spring and ball for sealing starter ports that lead from a gas inlet to the rotor chamber. Centrifugal force causes the ball to close off the starter port.

In Paschke U.S. Pat. No. 3,012,550 is disclosed a rotary device in which a rotatable outer body is provided with cooling fins.

In many known rotary devices, rotor wobble is a problem. For example, in Wankel engines, the ring gear is mounted flush with the face of the rotor and is part of the rotor. The gear teeth are typically involute and the rotor is mounted with a single bearing on one side of the gear. Both tangential and radial force components are possible with the involute gear teeth so that the radial components cause the rotor to tip about the bearing as it revolves. Although various means are used to counteract this tipping, some wobble still occurs. The seals are unable to react fast enough to provide a good seal so that oil passes the seal grid and contact and compression is lost.

SUMMARY OF THE INVENTION

The present invention provides an economical, compact and efficient rotary air compressor of an outer envelope, epitrochoidal design. The inventive compressor construction reduces the risk of damage to seals and reduces the starting torque required of a prime mover. Wobble is eliminated during running of the device and seal effectiveness is thereby improved. The present invention also provides efficient and effective lubrication, and cooling and avoids the injection of compressed air into the lubrication system of the air compressor.

Also provided is a high speed lubricant and coolant pump adapted to operate at motor speeds.

These and other objects, advantages and features of the invention are achieved in a rotary, epitrochoidal air compressor having a rotating housing portion mounted for rotation on a stationary housing portion and having a stationary compressor shaft extending between the two housing portions on which is mounted a epitrochoidal outer envelope rotor. The epitrochoidal outer envelope rotor has a lobed outer contour in the shape of an epicycloid and is mounted for movement on an eccentric axis. The rotor is contained within a rotor chamber in the rotating housing portion which is of an inner contour in the shape of an envelope conjugated with the epicycloid of the rotor. The rotor and rotating housing portion are geared together so that when the rotating housing portion is driven by a prime mover, the epitrochoidal rotor is driven to compress air within the rotor chamber for use externally of the present device.

The stationary compressor shaft on which the rotor is mounted includes a single eccentricity, or offset, near one end to form a single offset shaft extending between the rotating housing portion and the stationary housing portion. The epitrochoidal rotor is mounted by bearings on the single offset shaft so that it rotates freely on the shaft. A pinion gear, which is either integrally formed with the rotor or which may be fixed thereto, meshes with a ring gear within the rotating housing portion to drive the epitrochoidal rotor as the rotating housing portion is driven. Both the housing and the rotor rotate with respect to fixed axes so that counterbalancing problems are avoided, yet each rotate on a mutually different axis so that their motion relative to one another is epicyclic.

Preferably, an outrigger bearing is provided on the rotor so that bearings are on either side of the pinion gear. This eliminates wobble in the rotor and enables the rotor to run true. A significant advantage is thereby provided since seals do not have to accommodate rotor wobble and are thus more effective.

During rotation of the rotating housing portion, air is drawn in through air inlets into the rotor chamber and is compressed. When compressed, the air is driven from the rotor chamber through outlet valves in a valve plate and is fed to a compressed air outlet of the air compressor device. Since the rotor chamber and outlet valves are found in the rotating housing portion and the compressed air outlet is in a stationary portion of the device, rotary air seals are provided between the two relatively movable portions. When the air is compressed, it becomes heated. To prevent the rotary air seals from overheating and thereby to maintain their efficiency and prolong their life as heated compressed air passes therethrough, an air cooler is provided in the rotary housing portion to cool the compressed air after compression but before contact with and transmittal through the rotary air seals. Cooling of the compressed air takes place after the air is compressed, wherein the cooling is performed by an after-cooler. In addition, cooling may also be performed at some intermediate stage of compression, which is performed by an inter-cooler.

The rotary air cooler, whether an after-cooler or an intercooler, one of a preferred embodiment includes a rotating, externally finned, cooling chamber through which the compressed air is fed. The finned cooling chamber rotates as part of the rotating housing to provide an air flow over the fins for efficient cooling without requiring an additional, external air mover. A relatively smaller surface area of the rotating fins provides more efficient cooling compared to a more usual stationary surface over which moderate amounts of air are blown by an external air mover. In one embodiment, both an intercooler as well as an aftercooler are provided for maximum cooling of the compressed air.

Another embodiment provides a flow of a coolant liquid, such as oil, over the inter-cooler for heat transfer.

To avoid the initial load on a prime mover typically found in air compressors, an air pressure unloader is provided in the present device. The air pressure unloader of a preferred embodiment operates through centrifugal force and includes a ball valve mounted on a radially-biased spring for selectively opening and closing an exhaust port. The exhaust port is open during start-up of the present compressor and then, after reaching a predetermined percentage of operating speed, the ball valve closes the exhaust port so that air being compressed by the compressor is no longer exhausted to the atmosphere but instead is fed to the compressed air outlet.

The air pressure unloader is also effective to release the load caused by the compression of air as the compressor is stopped. The unloader releases when the speed of the compressor falls below the predetermined speed. This releases compressed air from the compressor compartments and avoids possible damage to air seals which may be caused by compressed air being held within the compressor when it is not in operation. Without compressed air remaining in the compressor compartments, the problem of purging of the oil is also avoided.

To ensure that maximum efficiency is retained and that no compressed air escapes from the rotor chamber during operation, such as into the lubrication system, an improved compression seal grid is provided between the lateral faces of the epitrochoidal rotor and the corresponding lateral faces of the rotor chamber. The compression seal grid includes split ring seals mounted in circular grooves in the opposite walls of the rotor chamber. The split rings are biased against the lateral faces of the epitrochoidal rotor at a plurality of distinct locations by spring-loaded buttons. The spring-loaded buttons of the preferred embodiment fill the radial gap between the compression seal ring and the apex seals of the epitrochoidal rotor chamber. Each split ring seal passes over cut-outs in the buttons which are equal to the width of the ring seals, thereby holding the seal against the face of the rotor. As the rotor moves within the chamber, the buttons are rotated enough to force the cut out against the ring seal and prevent rotation of the ring as the rotor rotates. In a second embodiment, a pin is provided in one of the buttons between the ends of the split ring to prevent its rotation.

An improved lubrication system for the present invention centrifugally drives lubricant through the present engine. Lubricant is fed from an external, positive displacement pump into a internal bore in the stationary compressor shaft from which it flows to a discharge channel in the surface of the hollow shaft. The lubricant flow path continues from the discharge channel to the rotor pinion gear, rotor bearings, and to the bearings which mount the stationary housing portion on the rotating housing portion. The lubricant flow path includes a radially extending channel in the rotating housing portion for centrifugally driving the lubricant flow so that the lubricant continues through the compressor apparatus to a lubricant outlet. The rotational motion of the rotating housing portion is, thus, used to at least assist in the flow of the lubricant through the device. In another embodiment the lubricant flows through the hollow shaft and out an opening in the end thereof, from which it is directed to the various bearings.

In addition to providing lubrication of the moving parts, the lubricant flows may also be relied on for heat removal as well. By providing an increase in the flow rate and by providing additional lubricant carrying channels, heat is carried away from the compression chambers and air coolers. An oil cooled embodiment includes an oil cooler which receives the heated oil and cools it by blowing air over a finned outer surface. Blowing of the air is accomplished by the rotating blades on the housing.

The positive displacement pump for the lubricant may be driven by the prime mover for the compressor so that no external pump driver is required. In one embodiment, the lubricant pump is connected to an end of the motor shaft opposite the end which drives the compressor. Another arrangement includes an oil pump mounted directly to the stationary housing portion and driven by an outrigger from the compressor rotor. Since such oil pumps run at motor speed, the pump is of an epitrochoidal rotary design to avoid cavitation. The epitrochoidal rotor engages a rotatable ring gear lying on an eccentric axis in the pump housing. The rotor is of a relatively large internal diameter to accommodate the rotor outrigger, and both the rotor and ring gear are relatively thin axially.

Various embodiments of the invention are disclosed having different features and improvements. Some are constructed of a reduced number of parts, and are more compact and efficient than others. An improved air flow path is provided in an exemplary embodiment. In this embodiment, environmental air is drawn into three of the four air compression chambers where it is compressed. The compressed air then passes through an intercooler for intermediate cooling, after which it passes through the fourth air chamber for a second stage of compression and then to an outlet. The outlet preferably includes a chamber provided with external blades to form a blower. Some heat may also be conducted through the blades and thereby provide two stage cooling of the compressed air.

The outlet chamber of this further embodiment is connected to the motor shaft of the prime mover, the motor shaft being hollow so that the compressed air flows therethrough to the opposite end of the motor. Air seals at this opposite end of the motor which are provided between the rotating motor shaft and a stationary outlet line are thereby smaller than in the previous embodiment.

Thus, there is provided novel and efficient air compressors having numerous advantages and improvements over the prior art. In particular, wobble is eliminated to improve seal operation and provide smoother running of the device. The manufacture of a single offset shaft is less involved and less expensive than for a double offset shaft; furthermore, the use of a stationary shaft eliminates the need for counterweights and therefore provides automatic dynamic balancing of the entire compressor device. Assembly of the present device is also facilitated by the single offset since the rotor and rotor bearings are easily slid on the single offset, which is not possible with a conventional single offset shaft.

For the air pressure unloader, compressed air remaining in the compressor after it is shut-off is exhausted to the atmosphere so that no compressed air remains between the compressor and a check valve, such as in a compressed air storage tank, prolonging the life of the seals and valve. Secondly, minimum torque is required during start-up since pressure buildup is prevented until a predetermined percentage of rotational speed is achieved. Therefore, a smaller, more efficient prime mover is used compared to that which is necessary for starting a compressor with a full load. The percentage of rotational speed at which the unloader operates and the compressor begins compressing air can be set to match the torque characteristic of the prime mover. Depending on the prime mover used, unloader preferably switches to its air compressing position at approximately the time the starting coil of the electric motor or engine switches off.

The compression seal grid for the present invention prevents compressed air from leaking radially inward between the face of the rotor and the face of the rotor chamber so that contamination of the lubricating oil is prevented. Efficiency of the compressor is also maintained at a high level by the improved seal offered by the compression seal grid.

The lubricating system provided for the present apparatus both lubricates the friction surfaces and cools the various parts of the compressor which otherwise become hot during operation. Centrifugal force is used to circulate the lubricant through and out of the compressor on a continual basis.

BRIEF DESCRIPTION OF THE DRAWINGS

FIGS. 13 is a fragmentary cross section of a further embodiment of an inter-cooler;

FIG. 14 is a cross section along line XIV—XIV of FIG. 12 showing an oil pump;

FIG. 15 is a plan view of a pump body of the oil pump of FIG. 14.

DESCRIPTION OF THE PREFERRED EMBODIMENTS

Figure 1:
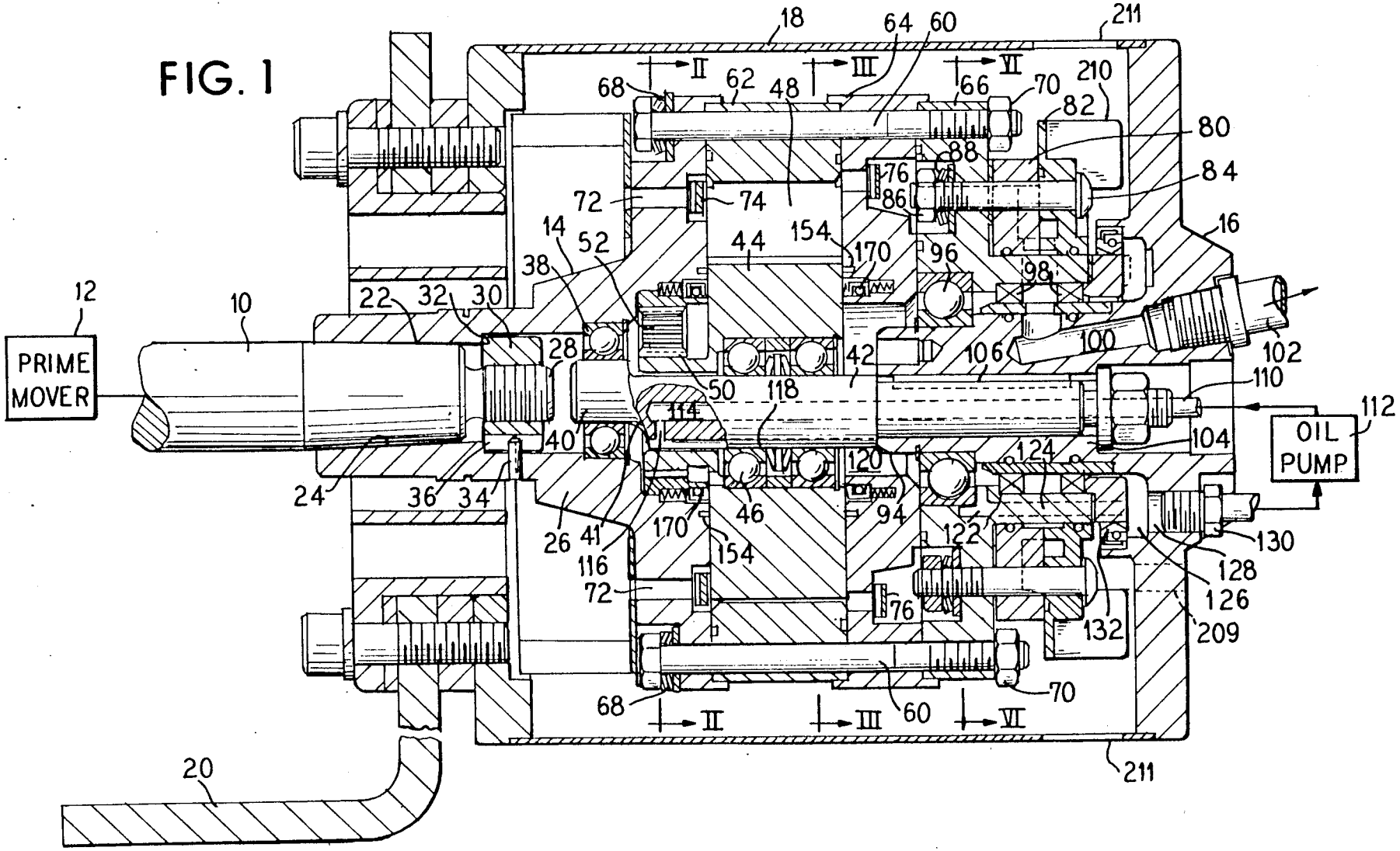
FIG. 1 is a longitudinal cross section through a rotary epitrochoidal air compressor according to the principles of the present invention.

Referring first to FIG. 1, a rotary epitrochoidal air compressor according to the present invention is shown in cross section including, generally, a power input shaft 10 driven by a prime mover 12 and connected to a rotating housing portion 14. The rotating housing portion 14 is rotationally mounted on a stationary housing portion 16 to which is connected a cover 18 extending about the rotating housing portion 14. A mounting bracket 20 is connected to the cover 18 by which the present compressor is mounted, such as to a compressed air storage tank in which the compressed air produced by the present compressor is stored.

In more detail, the power input shaft 12 is tapered at an end 22, which is preferably a locking taper and which fits into a like-tapered opening 24 in a flange gear assembly 26. The free end of the power input shaft 10 has a threaded extension 28 on which is received a nut 30 which rests against a shoulder 32 to hold the tapered end 22 of the power input shaft 10 in the tapered bore 24. A lock pin 34 extends from the flange gear assembly 26 into a slot 36 in the nut 30 to selectively lock the nut 30 in position.

Mounted in bearings 38 in the flange gear assembly 26 is an offset, or eccentric, end 40 of a compressor shaft, 42. Also mounted on the compressor shaft 42 at the other side of an offset portion 41 of the compressor shaft 42 is a epitrochoidal rotor 44. The rotor 44 is rotatable on bearings 46 about the compressor shaft 42 and is positioned in a rotor chamber 48. The epitrochoidal rotor 44 includes an integral pinion gear portion 50 having teeth which mesh with a ring gear 52 in the flange gear assembly 26.

The rotating housing portion 14 is held together by a plurality of elongated bolts 60 which extend through bores in the flange gear assembly 26, a rotor housing 62 which encloses the rotor 44, a valve plate 64, and a seal housing 66. A Bellville, or spring, washer 68 is provided on each of the bolts 60, along with a threaded nut 70, to ensure that the elements are held together tightly.

Four inlet ports 72 with inlet valves 74 are provided in the flange gear assembly 26 opening into the rotor chamber 48. The inlet valves 74 of a preferred embodiment are reed valves mounted on a valve stop. The flange gear assembly 26 is shaped to provide valve seats. On an opposite side of the rotor chamber 48 in the valve plate 64 is four discharge valves 76, preferably of a similar type. Thus, air is drawn into the rotor chamber 48 through the air inlets 72 and the inlet valves 74, and after the air is compressed, it is forced out of the rotor chamber 48 through the discharge valves 76.

Before assembly of the seal housing 66 to the valve plate 64, the seal housing 66 is provided with a left cooler half 80 and a right cooler half 82 which are held to the seal housing 66 by a plurality of bolts 84 and nuts 86. A Bellville, or spring, washer 88 is also provided on each of the bolts 84 to ensure tight engagement between the seal housing 66 and the left and right cooler halves 80 and 82. The bolts 60 and 84 are provided at regularly spaced intervals about the circumference of the rotatable housing. The seal housing 66 is mounted for rotation on an extension 94 of the stationary housing portion 16 by bearings 96. Also between the extension 94 of the stationary housing portion 16 and the seal housing 66 is a pair of spaced outlet seals 98 between which passes compressed air to an outlet bore or tap 100 into which is threadably connected an outlet conduit 102. The outlet conduit 102 is connected to an air storage tank, for example. A plurality of seals, such as 0-ring seals, are provided between the various elements of the rotating housing portion 14 to prevent leakage of compressed air from the device.

The compressor shaft or single offset shaft 42 extends into a bore 104 that is offset from the center of the extension 94. The axis of the single offset shaft 42 is parallel to the axis of rotation of the rotating housing portion 14. The offset end 40 of the shaft 42, however, lies on the axis of rotation of the rotating housing. The compressor shaft 42 is held in non-rotatable engagement by a key 106 in corresponding slots in both the interior of the bore 104 and in the shaft 42 and is thereby fixed in the stationary portion 16.

Also shown in FIG. 1 is a lubrication system which includes a lubrication inlet conduit 110 which is fed by a positive displacement lubrication pump 112. The lubrication inlet conduit 110 is connected at the end of the compressor shaft 42 to feed oil into a bore 114 extending generally through the center of the shaft 42 and substantially along the length of the shaft 42 up to adjacent the offset portion 41. In the illustrated embodiment, the central bore 114 has a blind end intersected by a small radial bore 116 extending to the outside surface of the shaft 42. The radial bore 116 connects to a channel 118 that runs axially along the outer shaft surface, extending partially along the length of the shaft 42 and under the bearings 46. The axially extending channel 118 provides a lubrication flow path extending to an open interior area adjacent the bearings 38 for the eccentric shaft portion 40 and to the pinion gear portion 50. The lubricant flow path extends through the channel 118 to an open space 120 between the rotor bearings 46 and the housing bearings 9 to lubricate both sets of rotor bearings and the housing bearings 96. The housing bearings 96 are preferably open so that the flow path continues through the bearings 96 and to a small radial channel 122 that is in communication with an axially extending bore 124. The axial bore 124 opens at its opposite end to an oil collection reservoir 126 disposed between the rotating and stationary housing portions 14 and 16, respectively. In the stationary housing portion 126 is an oil outlet opening 128 into which is threaded a fitting 130 connected to the oil pump 112 or to an external oil sump. To close the oil reservoir 126, an annular oil seal 132 provides a seal between the rotating housing portion 14 and the stationary housing portion 16.

In operation, the positive displacement lubrication, or oil, pump 112 forces oil or other lubricant through the central bore 114 in the shaft 42 where it is drawn centrifugally through the bore 116 and out the channel 118 to the bearings 38 and to the pinion gear 50 of the rotor 44. 011 also is supplied to the rotor bearings 46 as well as to the bearings 96. Due to the rotational motion of the rotary housing 14, the radially extending opening 122 centrifugally urges the flow of oil from the bearing 96 along the bore 124 into the oil reservoir 126. The lubricant is then removed through the fitting 130 back to the lubrication pump 112. It may be possible in some applications to eliminate the oil pump altogether and utilize centrifugal force to generate and maintain the oil flow. The device is, thus, both lubricated and cooled by the lubricant flow.

Figure 2:
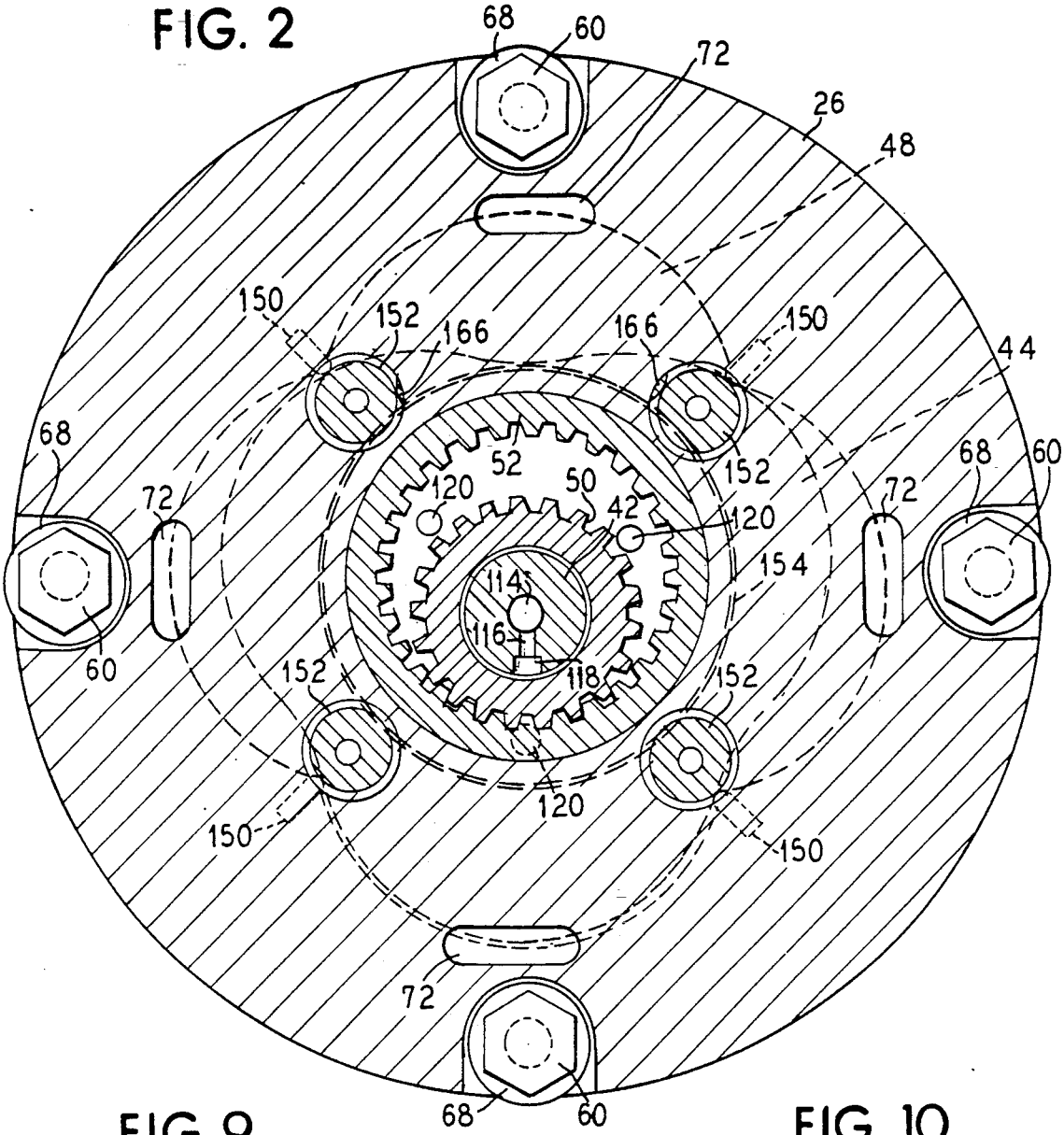
FIG. 2 is a cross section along line II—II of FIG. 1 showing pinion gear operation in the rotary housing portion of the air compressor.

Referring to FIG. 2, a cross section through the flange gear assembly 26 shows four symmetrically arranged bolts 60 with their associated spring washers 68. Also symmetrically arranged in the flange gear assembly are four air inlet passages 72 for admitting air into the rotor chamber 48, as shown in dotted outline. As can be seen, the rotor chamber 48 has four lobes, each with one of the air inlet passages 72 at the outer most portion thereof. Within the four-lobed rotor chamber 48, is the three-lobed, outer envelope epitrochoidal rotor 44, also shown in dotted outline. At each apex of the four-lobed rotor chamber 48 is a rotor seal 150 which provides a seal between the outer surface of the rotor and the apex of the rotor chamber to seal off the four portions of the rotor chamber from one another. A button seal 152 is provided at opposite ends of each of the apex seals, as will be described more fully in conjunction with FIGS. 3 and 4. Generally, however, the button seals 152 hold the apex seals axially in place and, in addition, provide a biasing force for an annular ring seal 154 against opposing faces of the rotor 44.

Within a central opening in the flange gear assembly is mounted the ring gear 52 for toothed engagement with the pinion gear portion 50 of the rotor 44. The pinion gear portion 50 encircles the power shaft 42, within which can be seen the central bore 114, the radial channel 116, and the axial lubricant channel 118. Three evenly spaced lubricant passages 120 extend through the rotor 44 through which oil flows to the outside surface of the rotor 44.

Figure 3:
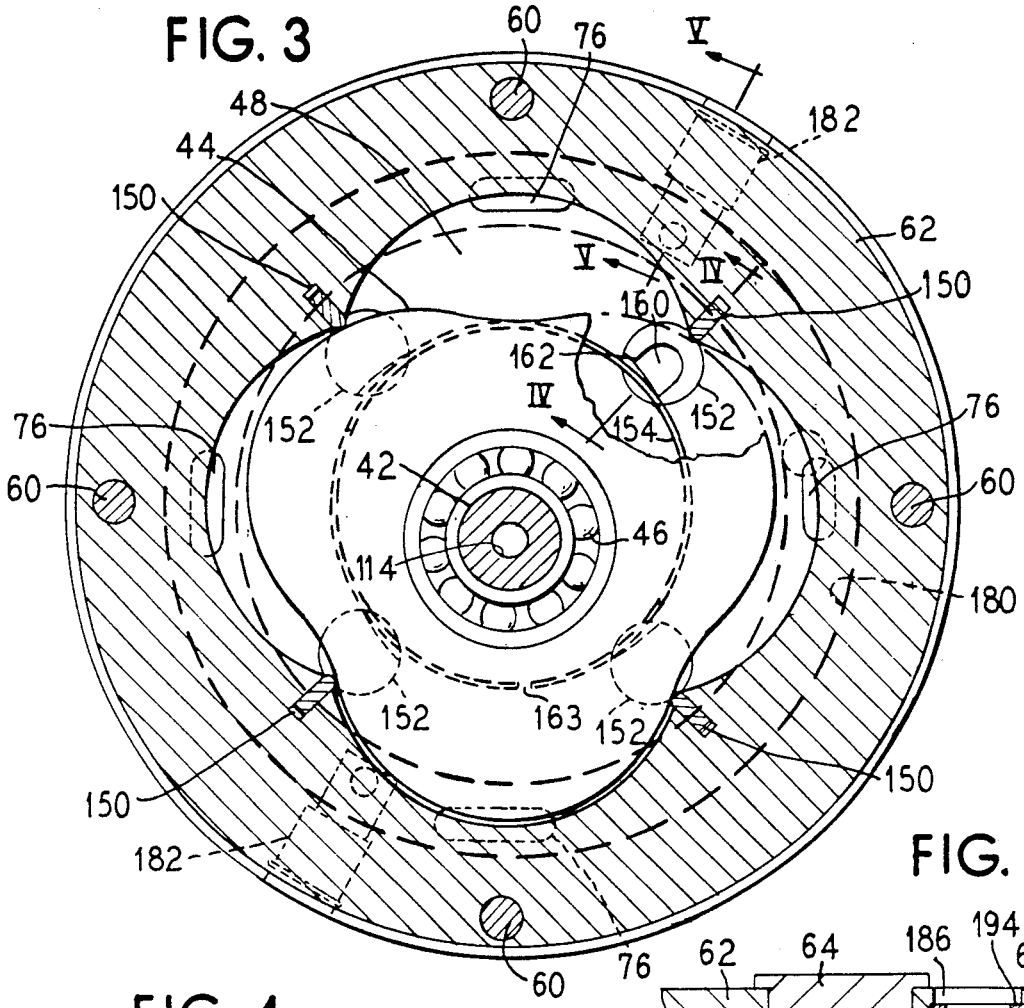
FIG. 3 is a cross section along line III—III showing the epitrochoidal rotor within the rotor chamber and including seal elements in the chamber.

In the cross section of FIG. 3, the three lobed epitrochoidal rotor 44 can more clearly be seen within the four lobed rotor chamber. The apex seals 150 at the four apex points of the rotor chamber 48 and the button seals 152 adjacent the apex seals 150 can also be seen. The button seals 152 of a preferred embodiment have a horse shoe shaped front face including a central recess 160 to reduce friction on the lateral faces of the rotor 44. A cut-out 162 in each of the button seals 152 accepts the ring seal 154.

The ring seal 154 is split at 163. Before being split, the ring seal 154 is of slightly smaller inside diameter than the diameter of the inside wall of a channel 168 in which the ring seal 154 is mounted. This causes the ring seal 154 to lie relatively tightly against the inside wall to provide a better seal. As the rotor 44 rotates in the rotor chamber 48, the button seals 152 are twisted somewhat. The twisting causes the cutout 162 to be urged against and, in effect, to bind the ring seal 154 and thereby prevent the ring from rotating with the rotor 44.

Figure 4:
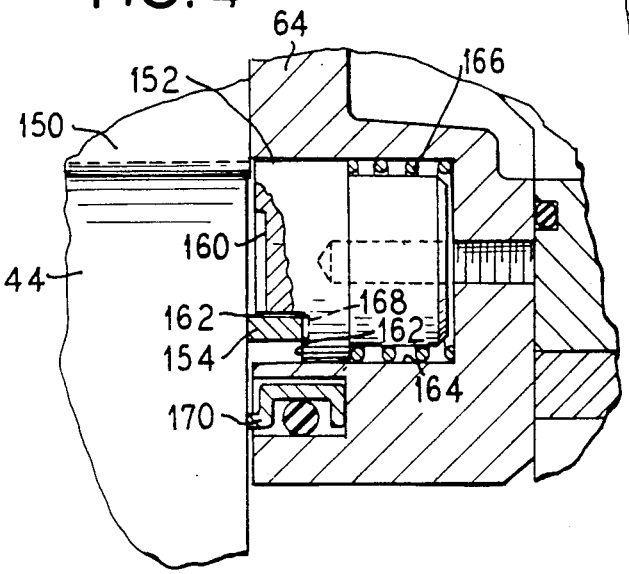
FIG. 4 is a cross section along line IV—IV of FIG. 3 showing a spring loaded button of the compression seal grid.

Referring to FIG. 4, the illustrated button seal 152 rests in a bore 164 in the valve plate 64 and is biased against the lateral face of the rotor 44 by a spring 166. From the view of FIG. 4, the split ring seal 154 can be seen riding in the cutout 162 of the button seal 152. Behind the button seal, shown in phantom, is the channel 168 in the valve plate 64 in which the ring 154 lies. The ring seal 154 has a greater axial dimension than the depth of the cutout 162 and so contacts the rotor 44 before the button seal 152. In one embodiment, the cutout 162 is between 0.0780 and 0.0795 inch deep, while the ring seal 154 is 0.080 inch wide. It is also contemplated that the ring seal lie flush with face of the button seal.

The spring 166 presses the split ring seal 154 against the lateral face of the rotor 44 so that portions of the split ring seal 154 at the button seals 152 are cause to wear at a greater rate then the portions of the split ring seal 154 lying between the button seals 152. Thus, the split ring seal 154 eventually wears thinner at the button seals 152. The thicker portions of the split ring seal 154 between the button seals 152 exert an increased lateral force on the face of the rotor 44 as a result of this wear. The urging of the thicker portions of the ring seal 154 against the lateral faces of the rotor 44 compensates for the lack of a biased button at these locations so that an improved seal between the buttons 152 is provided. The split ring seal 154, thus, provides an improved air seal to prevent the escape of pressurized air into the lubrication system from the rotor chamber during compression. The split ring seal 154 and buttons 152 are, of course, provided at both opposing faces of the rotor 44.

Since the pinion gear portion 50 extends axially of the rotor 44 rather than being inside the rotor meshing with a ring gear within the rotor, the rotor 44 is smaller. The ring seal 154 is smaller as well, and therefore, more effective than a larger ring seal would be. The smaller mass and more effective seal makes for improved efficiency over the known devices.

In FIG. 4 can also be seen an oil seal 170 which is provided at both sides of the rotor chamber 148 extending against the lateral faces of the rotor 44 to prevent oil from escaping from the lubrication system into the rotor chamber 48. As can be seen in FIG. 1, the oil seal !70 is biased against the lateral faces of the rotor 44 by springs.

Referring back to FIG. 3, the compressed air outlet valves 76 from the rotor chamber 48 open into an annular air outlet chamber 180 (shown in phantom) in the valve plate 64. Also opening to the annular air chamber 180 is a pair of air pressure unloader valves 182 which are shown in phantom in FIG. 3. The two air pressure unloader valves 182 are opposite one another relative to the rotational axis of the rotational portion 14 of the present apparatus to prevent an unbalanced condition from occurring during operation of the present pump.

Figure 5:
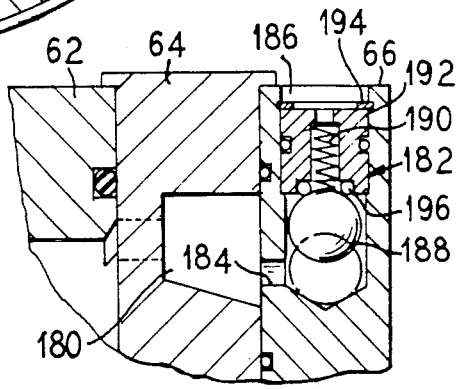
FIG. 5 is a cross section along V—V of FIG. 3 showing a ball valve of the air pressure unloader.

One of the air pressure unloader valves 182 can be seen in greater detail in FIG. 5 contained in the seal housing 66. A small lateral bore 184 extends from the annular air chamber 180 into a larger radially extending opening 186 which is open to the outside of the seal housing 66. Within the radially extending opening 186 is mounted a ball 188 that is biased radially inwardly by a spring 190, the spring 190 being mounted in a plug fitting 192. The plug fitting 192 is held within the opening 186 by a retainer ring 194 in a channel in the opening 186. A gasket seat 196 is provided on the inner surface of the plug 192 against which the ball 188 seats when centrifugally driven by the rotation of the housing 14.

When the rotational speed of the rotational housing 14 is insufficient to overcome the biasing force of the spring 190, the ball 188 is pressed away from the gasket seat 196 to open the unloader valve 182 to the outside. This results in the removal of substantial portions of the load on the prime mover 12 during start-up of the compressor.

In a preferred embodiment, the air pressure unloader valve 182 operates when the compressor reaches approximately 90% of its operating RPM, which preferably corresponds to an increase in torque of the prime mover. This occurs, for example, at approximately 90% of operating speed in a capacitor start motor. Not only does this remove the load from the prime mover 12 during start-up of the air compressor, but also the pressurized air is released from the internal chambers of the air compressor when the apparatus is stopped, thereby avoiding damage to and prolonging the life of the internal seals.

Figure 6:
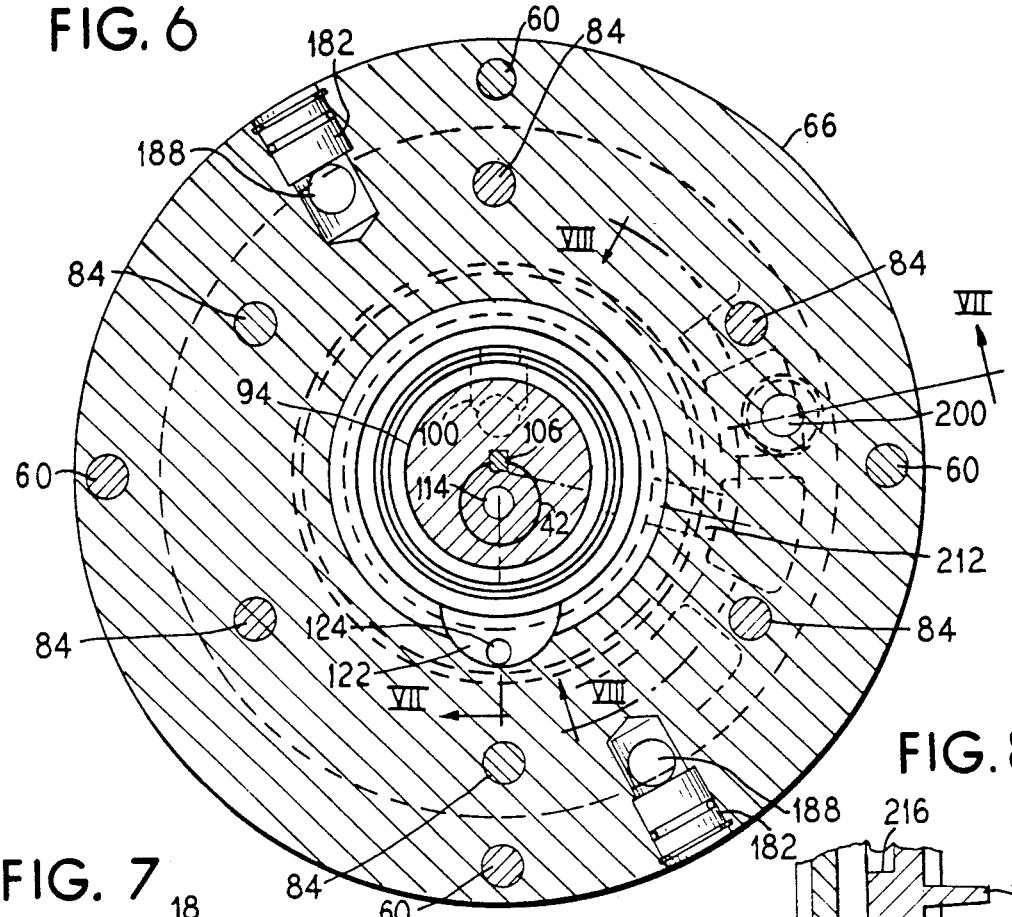
FIG. 6 is a cross section along VI—VI of FIG. 1 showing a seal mounting plate.

In the cross section of FIG. 6, the two air pressure unloader valves 182 can be seen in their opposing openings in the seal housing 66. Not only are the bolts 60 extending through the seal housing 66 shown spaced evenly about the housing, but also the bolts 84 for the air cooler sub-assembly are also shown in FIG. 6. Extending through the seal housing 66 is a bore 200 through which pressurized air flows during operation of the air compressor at rotational speeds above that which the air pressure unloader valves 182 operate. Also in FIG. 6 can be seen the space 182 opening radially from the bearings 96 on which the seal housing 66 is mounted on the extension 94. The recess 122 opens into the bore 124 to form a portion of the lubrication system. The compressor shaft 42 can be seen offset from the center of the rotating housing 14 in the extension portion 94, and the pressurized air outlet channel 100 is visible in dotted outline extending into the extension portion 94 opposite the compressor shaft 42.

Figure 7:
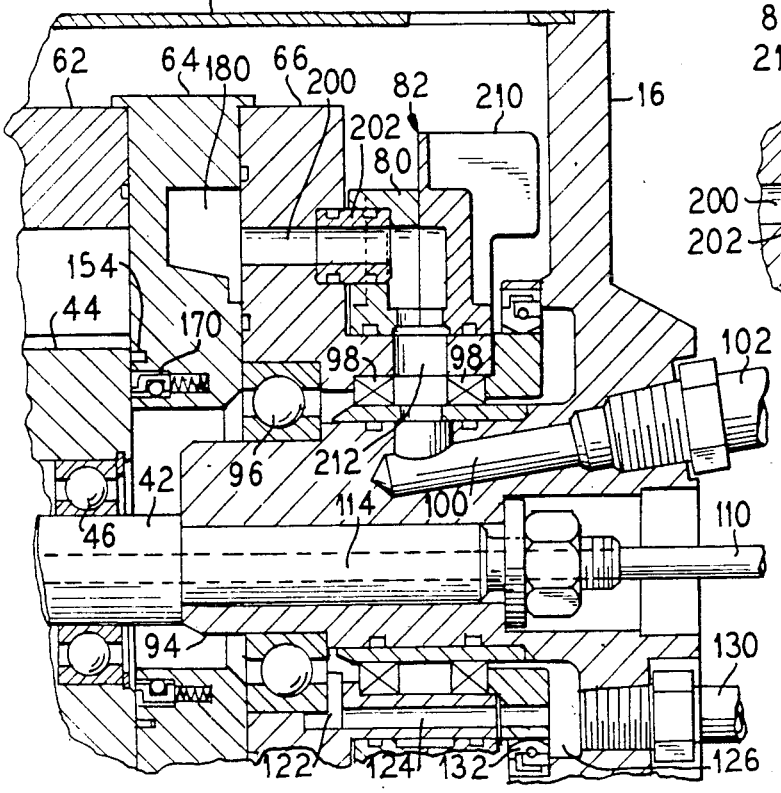
FIG. 7 is an enlarged cross section generally along line VII—VII of FIG. 6 showing elements of the rotary after-cooler and lubricating system.

In FIG. 7, the bore 200 in the seal housing 66 which extends from the annular air chamber 180 passes through a connector sleeve 202 into the rotary after-cooler formed by the left half air cooler 80 and right half air cooler 82. The connector 202 includes a pair of 0-ring seals for an air tight connection between the parts. The air cooler right half 82 includes a plurality of fins 210 extending radially along its outer surface to provide an enlarged heat dissipating surface area for cooling as the rotating housing 14 rotates. The fins 210 generate an air flow as the rotating housing portion rotates. In FIG. 1, this air flow enters through openings in the stationary portion 16, such as opening 209 and leaves through exhaust openings 211 in the cover 18.

Figure 8:
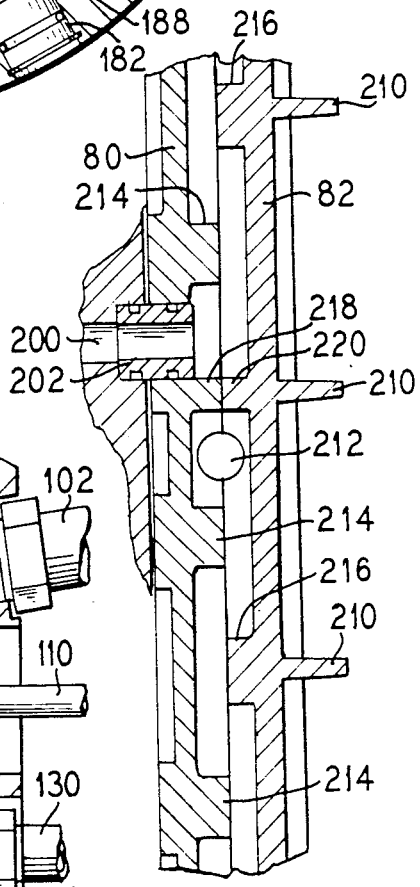
FIG. 8 is a developmental cross section along curve VIII—VIII of FIG. 6 showing a serpentine air flow path in the rotary after-cooler.

Within the after-cooler, a serpentine path extends from the inlet bore 200 to an outlet bore 212 spaced approximately 335° from the inlet bore 200. As can be seen in the developmental view of FIG. 8, wall portions 214 extending internally of the after-cooler left half 80 at regular intervals within the after-cooler are positioned between wall portions 2!6 extending internally of the after-cooler right half 82 to form the serpentine flow path. As can be seen in FIG. 8, each internal wall portion 216 has an external cooling fin 210 opposite it to dissipate the heat which is absorbed by the wall 216. The walls 214 on the left half 80 insure that the air in the after-cooler impinges the cooling walls 216 as it flows therethrough. A pair of opposed wall portions 218 and 220 on the respective after-cooler left and right halves 80 and 82 are joined to form a solid wall across the interior of the after-cooler so that air is forced to flow the entire 350° length of the after-cooler before passing through the opening 212.

As heated, compressed air flows along the serpentine path within the after-cooler, thermal energy passes to the after-cooler housing where it is removed to the fins 210. The rotating motion of the rotary housing portion 14 provides an extremely efficient air flow across the air cooling fins 210 so that the air temperature of the compressed air is reduced substantially before leaving the rotary compressor portion 14. In a prototype of the device, air that was compressed to 100 psi became heated to 470°. After passing through the after-cooler, the temperature of the air had been reduced to 270°.

Figure 9:
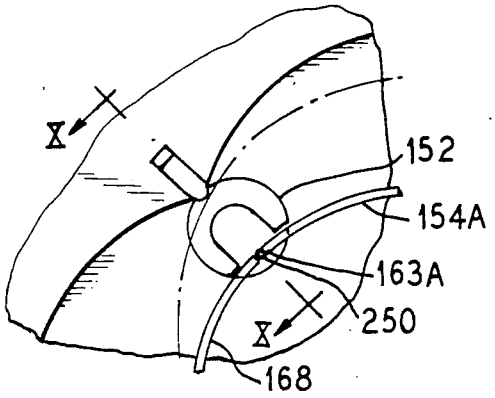
FIG. 9 is an enlarged fragmentary view of a spring button from second embodiment of a compression seal grid.
Figure 10:
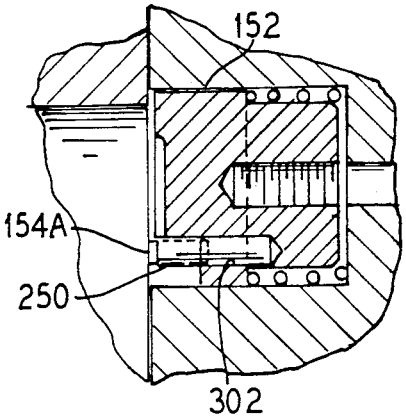
FIG. 10 is a cross section along line X—X of the spring button of FIG. 9.

FIGS. 9 and 10 illustrate an alternate embodiment for a split ring seal 154A. The ring seal 154A is similar to that described above in that it is originally of a slightly smaller diameter than the channel 168 in which it lies so that it seals by lying tightly against the inside wall of the circular channel. The ring seal 154A is also wider, axially, than the cut out 162 in which it rests in the button seal 152. However, since the prevention of rotation of the ring seal 154A is so important to maintain the seal characteristics between the button seals 152 as it wears, the embodiment of FIGS. 9 and 10 includes a pin 250 between ends 163A at the split, the pin extending into a bore 302 in one of the four button seals 152. The pin 250 more effectively prevents rotation of the ring seal 154A so that the desired wear at the button seals cannot shift. A further advantage is that the split 163A is at the button seal 152, which closes what could be a leakage path for the compressed air. To ensure that the pin 250 does not interfere with the rotor 44, it extends from the button seal 152 less than the ring seal 154A. Preferably, the pin 250 is flush or recessed slightly from the face of the button seal 152.

Figure 11:
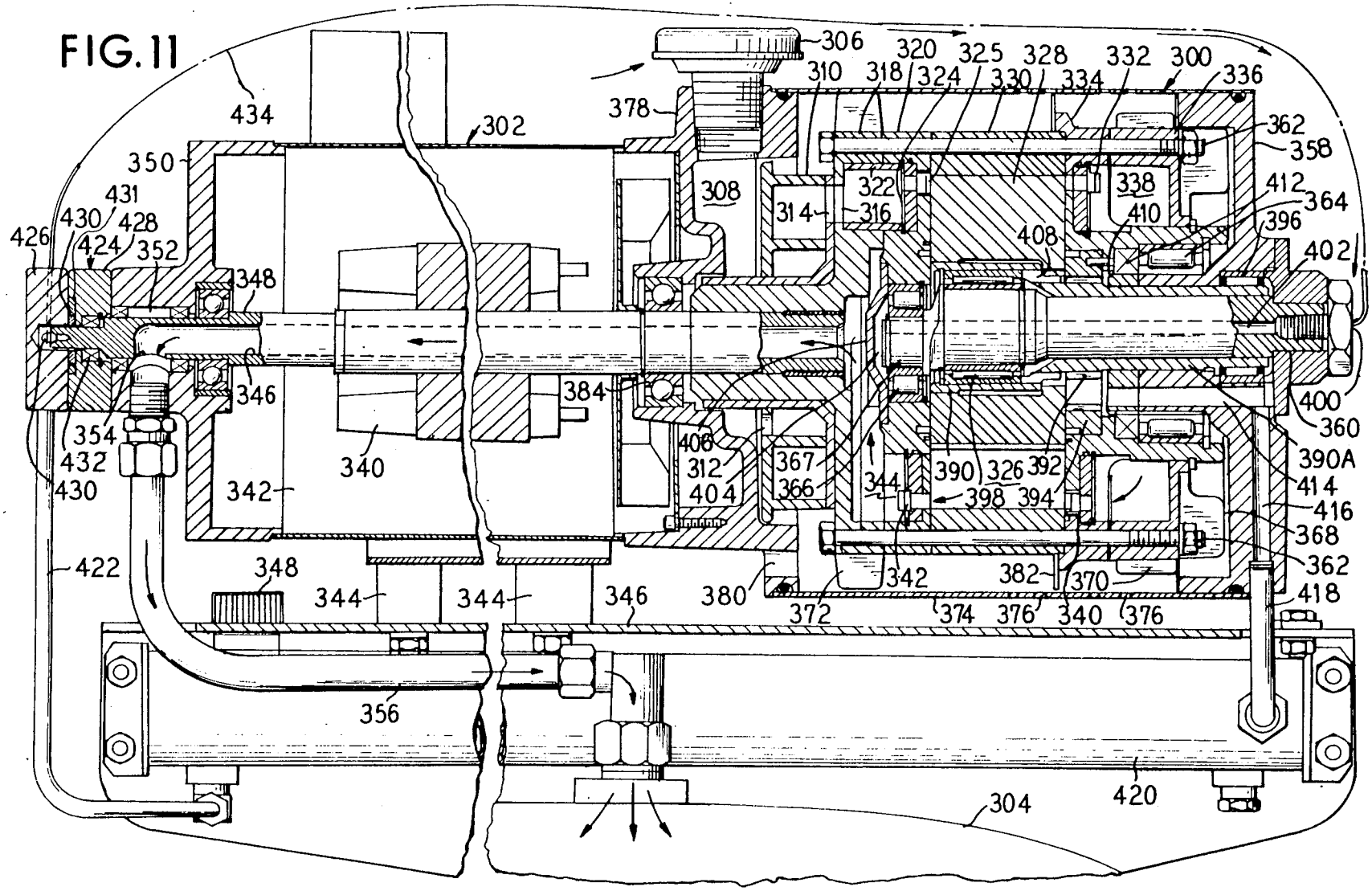
FIG. 11 is a longitudinal cross section of another embodiment of the invention, including an improved compressor, a drive motor and a lubrication system.

A second embodiment of the compressor is shown in FIG. 11 including a rotary compressor 300 driven by a motor 302 for pumping compressed air into a storage tank 304. The rotary compressor 300 has an air flow path which is somewhat different than in the previous embodiment. Features of this second embodiment can be incorporated into the foregoing embodiment, and vice-versa. First, air is drawn in through an air filter 306 into an intake chamber 308 and then into an muffler 310. The muffler 310 has an air intake opening at 312 and an air outlet at 314 which is connected by baffle chambers to reduce the wind noise of the air at the intake. The muffler 310, which operates on the Helmholtz principle, is mounted with its outlet 314 at an inlet 316 of a flange 318, which in turn is mounted on a valve plate 320. The air inlet passageway between the flange 318 and valve plate 320 is connected by an inlet tube or sleeve 322. A valve seat 324 on which is a reed valve 325 is mounted in the valve plate 320 to control the direction of air flow into a rotor chamber 326 within which a rotor 328 rotates. The rotor chamber 326 is formed by a rotor housing 330 to which the valve plate 320 is mounted. As in the first embodiment, the rotor chamber 326 has four lobes and the rotor 328 has three lobes. It is, of course, possible to apply the principles of the present invention to rotary devices, both engines and compressors, having different numbers and arrangements of lobe.

The rotation of the rotor 328 in the rotor chamber 326 compresses the air, or other gas, and forces the compressed air through a reed valve 332 mounted in an end housing 334. Mounted to the opposite side of the end housing 334 is an inter-cooler member 336 enclosing a cooling chamber 338. The cooling chamber 338 is annular in configuration and preferably has internal baffle walls as in the foregoing embodiment. A significant departure from the foregoing embodiment, however, is that there are valves letting compressed air into the cooling chamber 338 from only three of the four lobes of the rotor chamber 326. This is because only these three lobes have inlet valves 325 through which outside air is drawn for compression before passing into the inter-cooler.

The cooled air in the inter-cooler leaves the cooling chamber 338 through a valve seat and valve stop 340 into a fourth one of the lobes in the rotor chamber 326. In the fourth lobe, the cooled, compressed air undergoes a second compression stage and is then forced out through a valve seat and valve stop 342 into an outlet chamber 344 between the flange 318 and valve plate 320. From the outlet chamber 344, the compressed air passes through a central bore 346 in a motor shaft 348 of the motor 302.

Thus, the invention embodiment of FIG. 11 effect multistage compression, in this case two-stage compression, by virtue of appropriate relative positioning of intake and discharge valves in the valve plate 320 and the end housing 334. The first stage compressed air is delivered from the rotor chamber 326 through the reed valve 332 for containment in the annular cooling chamber 338, openings permit the first-stage compressed air to pass therethrough when a lobe chamber with which the valve 340 communicates is in an expansion mode. Disposed in the valve plate 320 relatively positioned to the valve 340 is the discharge valve 342 through which the second-stage compressed air passes from the previously mentioned lobe chamber into the outlet chamber 344 and then to storage.

At the opposite end of the motor 302 from the compressor 300 is a seal housing 350 having a air transfer chamber 352 into which a transverse opening 354 in the hollow motor shaft 348 opens. From the transfer chamber 352 is connected a transfer tube 356 which, through various fittings, transfers the air into the storage tank 304.

The second embodiment of FIG. 11 operates on many of the same principles as the first embodiment including having stationary and rotating housing portions wherein an end cover 358 in which a single offset shaft 360 is fixedly mounted is part of the stationary housing portion, while the flange 318, valve plate 320, rotor housing 330, end housing 334, and inter-cooler 336 are held together by bolts 362 and constitute the rotating housing portion. The parts constituting the rotating housing portion are mounted for rotation on the stationary housing portion by, for, example, roller bearings 364 at a first end of the single offset shaft 360 and cylindrical bearings 366 at an offset end 367 of the shaft 360. The offset end 367 is on the same axis of rotation as the rotating housing portion.

As the rotatable portion is rotationally driven by the motor 302, which in a preferred embodiment is a five horse-power motor, cooling fins 368 and 370 on the inter-cooler 336, as well as after-cooler fins 372 on the flange 318 are moved rapidly through the air to provide cooling of the compressed air at two stages. The inter-cooler 336 cools the air between the two compression stages. In the illustrated example, the fins 368, 370 and 372 rotate within a cylindrical protective housing 374 which is provided with a plurality of air outlet openings 376. The cylindrical housing 374 is supported on the end plate 358 at one end and on end shield 378 at the other end. To permit air to pass into the interior of the protective housing 374, air inlet openings, such as the opening 380, are provided in the end shield 378 and preferably also in the end plate 358. The movement of the fins 368, 370 and 372 draws a flow of air in through the air inlet openings 380 and forces warmed air out through the outlet openings 376. To maintain the cooling efficiency of the cooling fins, a deflector 382 is mounted between the sets of cooling fins so that the air passing over the inter-cooler fins does not mix with the air from the after-cooler fins. To prevent the cooling air for the after-cooler from mixing with the filtered air in the intake chamber 308, the muffler 310 is closely adjacent the stationary end shield 378 to form a seal therebetween. The muffler 306 is mounted in the end shield 378. The end shield also includes a central opening through which the motor shaft 348 extends and is mounted by ball bearings 384.

The rotor 328 is driven for rotation in the rotor chamber 326 by being fixedly mounted to a gear tube 390 having a hollow cylindrical portion mounted in a central opening of the rotor 328 and a second elongated hollow portion, or outrigger, 390A extending along substantially the length of the single offset shaft 360. The second portion 390A includes an arrangement of gear teeth at 392 for engagement with a ring gear 394 in the rotating portion of the compressor. The rotor 328 and gear tube 390, thus, move relative to the rotating portion as well as relative to the stationary portion of the compressor. The elongated hollow sleeve 390A is spaced from the single offset shaft 360 sufficiently to permit relative movement therebetween and is supported in the stationary portion by needle bearings 396, also referred to as outrigger bearings, between one end thereof and the end plate 358. The opposite end of the gear tube 390 is supported by needle bearings 398 on an enlarged portion of the single offset shaft 360. The rotor 328 is thus supported by bearings on either side of the pinion gear 392, enabling the rotor to run true. Ring seals and button seals of the type described above are provided on the opposite walls of the rotor chamber 326. Since the rotor 328 runs true, the seals do not have to compensate for rotor wobble and are, therefore, more effective.

An improved oil flow path is provided in the second embodiment. In particular, oil or other coolant or lubricant is pumped through a plug 400 into a bore 402 running longitudinally of the single offset shaft 360. The oil passes through the bore 402 and out an opening in the offset end 367 of the shaft 360 into a first oil space 404 which is separated from the air flow path 344 by a valve plate cap 406. The oil flow then passes through the cylindrical bearings 366 and through the needle bearings 398 to axial oil holes 408 in the gear tube 390. The oil flow continues through the gear teeth of the gear tube 390 as it meshes with the ring gear 394 and then through an opening in a seal race 410 mounted in an oil seal 412. The opening in the seal race 410 is in communication with an axially directed bore 414 in the end plate 358 which leads to a radial bore 416, also in the end plate 358. A tube 41 extending into the bore 416 carries the oil into an oil tank or reservoir which has a filler cap 421.

Once oil is in the oil tank 420, it is drawn out through an outlet tube 422 into a gerotor oil pump 424 generally comprising a pump cover 426, a pump housing 428, and a gerotor 430 and ring 431 mounted in the pump housing 428 on a end of the motor shaft 348. The oil enters the gerotor oil pump 424 through an opening 430 in the pump cover 426. Bearings 432 are also provided in the oil pump 424. The oil is pumped from the oil pump 424 through an oil tube shown schematically by the line 434 to the bore in the single offset shaft 360.

The motor 302 which is a known electrical motor having a rotor 340 and stator 342, thus, drives both the air compressor as well as the oil pump to provide a generally self-contained unit. The motor 302 rests on feet 344 bolted to a bracket 346 to which is also mounted the compressor 300, and the oil tank 420. The bracket 346 is preferably mounted to the top of the air reserve tank 304 into which the compressed air is sumped.

Figure 12:
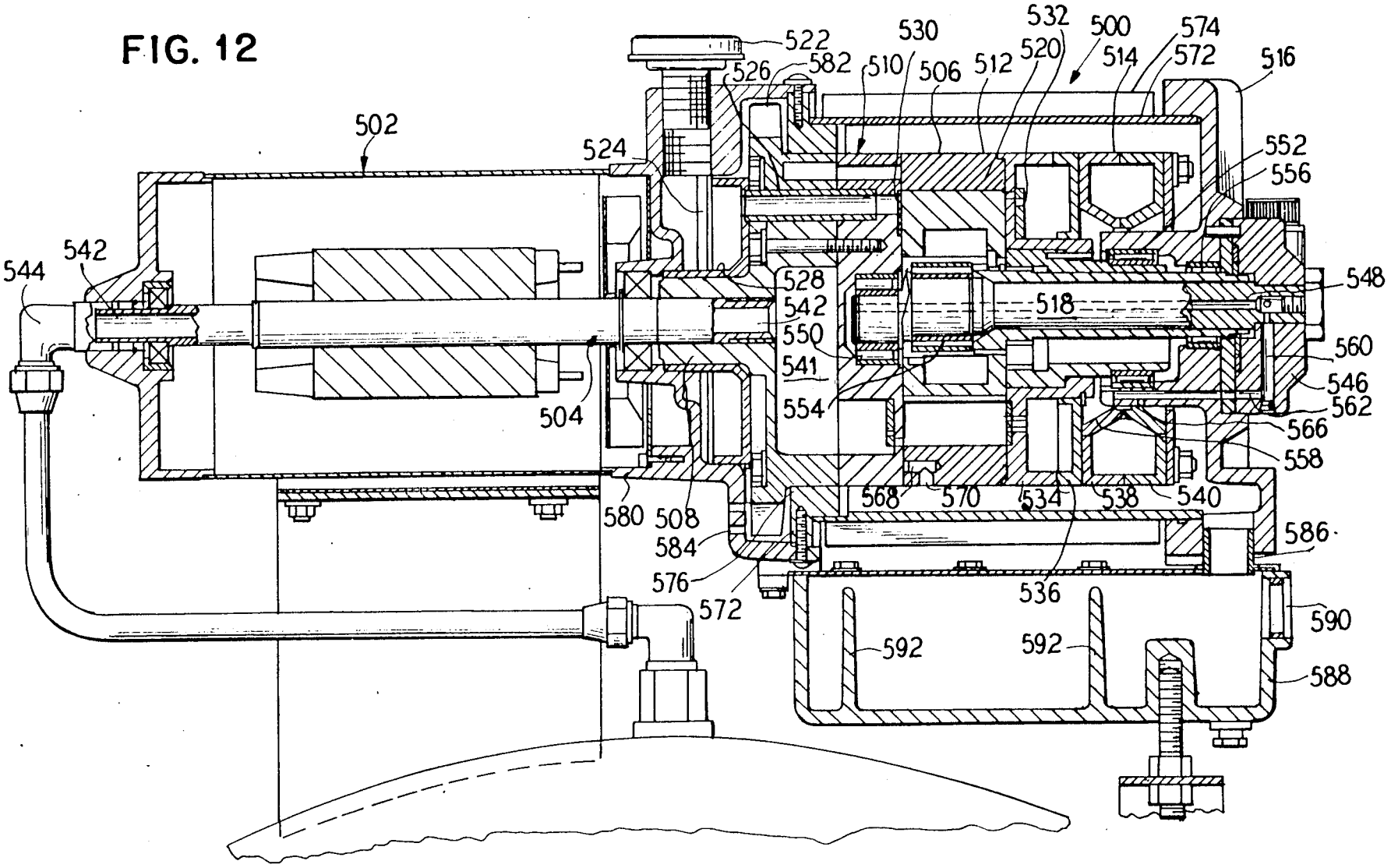
FIG. 12 is a longitudinal cross section of yet another embodiment of the present invention which is oil cooled.

A further, preferred embodiment of the invention is shown in FIG. 12 which operates on many of the same principles as the preceding embodiments, but which is primarily oil cooled instead of being primarily air cooled. A compressor 500 is connected directly to a motor 502 by a shaft 504 to drive a rotatable portion 506 of the compressor 500. The rotatable portion 506 is formed of a flange 508, a valve plate 510, a rotor housing 512, and an inter-cooler 514. As with the preceding embodiments, the rotatable portion 506 is mounted for rotation on a stationary end cover 516 and a rotor 520 is mounted on the shaft 518 within the rotor housing 512.

The air flow path through the compressor 500 is into an air filter 522, into an intake chamber 524 and then through an inlet insulator tube 526. An insulating liner 52 is provided in the intake chamber 524 to dampen noise. The air flow path continues through inlet valves 530 for three of the four chambers within the rotor housing and, once compressed, through the corresponding outlet valves 532. Since the compression of the air has heated the air, the air flow path flows through the inter-cooler stage 514 which, in the illustrated embodiment includes an end housing 534, a collector 536, and right and left inter-cooler halves 538 and 540. Once cooled, at least to some extent, the compressed air passes into a fourth one of the compressor chambers for a final compression; after which it is forced into an outlet chamber 541 in the flange 508 and through a central passageway 542 in the motor shaft 504 to an outlet 544.

Instead of fins being provided on the outer surface of the inter-cooler, an oil flow is directed over or through the intercooler 514 to carry away heat. The oil flow path of this embodiment begins with oil being pumped by an oil pump unit a 546, as will be described in greater detail hereinafter, into a central bore 548 of the compressor shaft 518. As with the preceding embodiment, the oil flows through the central bore 548 and through bearings 550 and 552 supporting the rotatable portion 506 and bearings 554 and 556 supporting the rotor 520. After passing through the bearings 552, the oil flows onto an inside surface of the inter-cooler stage 514 at space 558. Radial oil flow passages (not shown) are provided between the collector 536 and the left cooler half 538 through which the oil flows, carrying heat away from the inter-cooler stage 514. The oil pump 546 is designed to pump a greater quantity of oil than is required for lubrication and thus some of the oil being pumped is directed in oil flow paths solely to carry away heat for example, a radial bore 560 in the pump housing, in the outer end of which is a plug 562, connects to a passageway 564 which leads to the space 558. Additional cooling oil is thereby supplied to the inner surface of the inter-cooler 514. The passageway 564 has an additional outlet 566 which directs a flow of oil to the right cooler half 540 of the inter-cooler 514.

The inter-cooler 514 is not the only part being cooled by the oil. Radial passageways (not show) extend through the valve plate 510 from the space adjacent the free end of the single offset shaft 518. The radial passageways are between inlet and outlet valve mounting sectors, and in a preferred embodiment there are four such radial passageways. The radial passageways are threaded at their outer ends to receive a plug with a hole in it to control the flow of oil through the passage. The radial passageways connect to bores 568 extending into the rotor housing 512. Radial bores 570 connect to the bores 568 and plugs with holes in them are fitted into the radial bores 570. Oil, thus, also flows through these passages in the rotor housing 512 to provide cooling. Oil flow rate is controlled by using plugs having different size openings in the radial bores 570 and the radial passageways.

These various passageways fling the oil radially outward by centrifugal force so that the oil carries with it excess heat generated by the compression of the air. The oil is thrown against an inside surface of a cylindrical oil cooler 572 which has a smooth inner surface encircling the rotating housing portion 506 and a plurality of fins 564 provided on its outside surface. The heated oil is thereby cooled through the finned outer surface of the oil cooler 572. The fins 572 are exposed to atmospheric air in the illustrated embodiment.

Oil is prevented from leaving the interior of the oil cooler 574 at the left-hand side, with respect to FIG. 12, by a series of clearance seals 576 between the rotating portion 506 and a groove seal 578 held by an end shield 580. Within the end shield 580, the flange 508 includes a plurality of fins 582 forming an aftercooler. The fins 582 move through the air as the rotating portion 506 rotates and are thereby cooled so that heat from the compressed air in the outlet chamber 541 is removed. The rotating fins 582 draw in air through a series of air openings 584 in the end shield 580 and force it through openings (not shown) between the end shield 580 and the groove seal 578. The air thus directed flows over the finned outer surface of the oil cooler 572 for faster heat removal.

Once oil enters the oil cooler 572, it flows downward through a drain 586 into an oil reservoir 588. An oil level gauge 590 is provided on the oil reservoir 588. Oil from the oil reservoir 588 is drawn therefrom by the oil pump 546 through a conduit (not shown) to recirculate once again through the compressor. Baffles 592 in the oil reservoir 588 cause the oil to circulate through the reservoir in a flow path along the outer wall of the reservoir to thereby cool the oil.

FIG. 13 shows a further embodiment of an inter-cooler stage 600 for an air compressor similar to that shown in FIG. 12. In FIG. 13, the inter-cooler 600 is formed of only two parts, a left cooler half 602 and a right cooler half 604. These two pieces replace the four part inter-cooler of the previous embodiment and, thus, simplifies the manufacture and reduces the cost of the air compressor apparatus.

Oil flow also cools this embodiment of the inter-cooler 600. After flowing over the pinion gear 606 and into a space 608 between a rotating housing portion 610 and a rotor outrigger 612 and through bearings 614, the oil reaches the space 616. It also reaches the space 616 through passageways 618 and 620. From the space 616, the oil flows around the outside surface of the inter-cooler 600, while the heated air flows through the inside thereof so that heat is removed therefrom.

The flow of oil, or other lubricant or coolant, is driven by an oil pump 630 which is a non-cavitating, high-speed pump mounted directly on the stationary housing portion 632 and driven by the rotor outrigger 612. Within a pump housing 634 is a thin trochoidal rotor 636 within a rotor ring 638. The rotor 636 has a large inner diameter to fit over the outrigger 612 and a relatively small outside diameter. The rotor ring 638 and rotor 636 rotates in the pump housing 634 during operation of the pump, albeit at different speeds to move the oil from an inlet to an outlet.

The cross-sectional view of FIG. 14 shows the rotor ring 638 in the pump housing 634, the rotor ring having thirteen shallow lobes. The rotor 636 mounted within the rotor ring 638 has twelve projection extending from its outer surface which mesh with the rotor ring lobes in a planetating-type motion. The rotor ring 638 rotates on a different, although parallel, axis of rotation than the rotor 636.

As can be seen, flats 640 are provided on the outrigger 612 onto which the rotor 636 is mounted. Shown in phantom in FIG. 14 are passages 642 and 644 connected to the central passage 646 in the single offset shaft 648. The passages 642 and 644 direct the output of the pump into the central bore 646 of the shaft 648 and into the passageway 618.

In FIG. 15, the pump housing 634 includes mounting holes 650 and 652. The mounting holes 650 extend all the way through the pump housing 634, while the hole 652 only receives a mounting pin 654, as shown in FIG. 13. On the face of the housing 634 is a circular recess 656 that is centered a bout an axis distinct from the axis of a bore 658 which receives the single offset shaft 648. The circular recess receives the rotor ring 638.

Extending into the pump housing 634 is a pump inlet chamber 660 and a pump outlet chamber 662. An inlet bore 664 shown in phantom receives oil from a conduit (not shown) connected thereto. As the rotor 636 and rotor ring 638 rotate within the recess 656, cavities are formed between the rotor 636 and rotor ring 638 and increase in size, thereby drawing oil into these constantly forming cavities. The cavities travel across a wall 664 between the chambers 660 and 662, and when over the outlet chamber they begin to decrease in size. This causes the oil carried therein to be forced into the outlet chamber 662.

Once in the outlet chamber 662, the oil flows through bore 666 into the passage 642 in the single offset shaft and then through the center bore 646. For the oil cooled models of FIGS. 12 and 13, the out-flowing oil also flows through passage 644 and into bore 668 and then to passageway 618. Plugs 670 and 672 are inserted into the respective bores 668 and 666 to block oil flow in unwanted directions.

The oil pump as disclosed runs at or near motor speeds without cavitating and thus, does not require a gear reduction or other linkage but instead is directly connected to the compressor unit. Of course, oil pumps utilizing the principles of this invention may be used in other application as well.

Although other modifications and changes may be suggested by those skilled in the art, it is the intention of the inventor to embody within the patent warranted hereon all changes and modifications as reasonably and properly come within the scope of his contribution to the art.

I claim:

1. A rotary device, comprising:

a power transmitting shaft extending along a first axis;

a stationary housing;

a rotatable housing portion connected directly to said power transmitting shaft and rotationally mounted on said stationary housing for rotation about said first axis, portions of said rotatable housing forming a rotor chamber, said rotatable housing portion including a ring gear;

a rotor mounted in said rotor chamber and rotationally movable in said rotor chamber about a second axis distinct from said first axis but parallel thereto; and a single offset shaft mounted in said stationary housing and fixed with respect to said stationary housing, said single offset shaft having a first portion coaxial with said first axis and a second portion coaxial with said second axis, said rotor being mounted for rotation on said second portion of said single offset shaft and said rotatable housing being mounted for rotation on said first portion of said single offset shaft, said first portion of said single offset shaft being a free end.

2. A rotary device as claimed in claim 1, further comprising:

an arrangement of valves mounted at said rotor chamber for controlling movement of gas into and out of said rotor chamber so that a first portion of said rotor chamber is operable as a first compressing stage and a second portion of said rotor chamber is operable as a second compressing stage.

3. A rotary device as claimed in claim 1, further comprising:

a motor having a motor shaft connected to rotate said rotatable housing portion, said motor shaft being hollow; and means for directing gas from said rotor chamber into said hollow motor shaft.

4. A rotary device, comprising:

a power transmitting shaft;

a stationary housing;

a rotatable housing portion connected to said power transmitting shaft and rotationally connected to said stationary housing for rotation about a first axis, portions of said rotatable housing forming a rotor chamber;

a rotor mounted in said rotor chamber and rotationally movable in said rotor chamber about a second axis distinct from said first axis but parallel thereto; and a stationary shaft connected between said stationary housing and said rotatable housing portion and fixed with respect to said stationary housing, said rotor being mounted for rotation on said stationary shaft;

wherein said rotor includes a pinion gear portion integrally connected to said rotor and extending axially of said rotor, and wherein said rotatable housing portion includes an internally toothed ring gear being in cooperative engagement with said pinion gear portion of said rotor, said pinion gear portion being driven by said ring gear during rotation of said rotatable housing portion to move said rotor in said rotor chamber.

5. A rotary device as claimed in claim 4, further comprising:

an outrigger bearing member extending from said rotor to a bearing on an opposite side of said pinion gear portion from said rotor.

6. A rotary device, comprising:

a power transmitting shaft;

a stationary housing;

a rotatable housing portion connected to said power transmitting shaft and rotationally connected to said stationary housing for rotation about a first axis, portions of said rotatable housing forming a rotor chamber;

a rotor mounted in said rotor chamber and rotationally movable in said rotor chamber about a second axis distinct from said first axis but parallel thereto;

a stationary shaft connected between said stationary housing and said rotatable housing portion and fixed with respect to said stationary housing, said rotor being mounted for rotation on said stationary shaft;

said rotary device being driven by a prime mover, and means for automatically reducing start-up load on said prime mover by said rotary device during start-up.

7. A rotary device as claimed in claim 6, wherein said rotary device is a compressor for compressing a gas, and said start-up load reducing means includes a centrifugally operated valve in said rotatable housing portion, said centrifugally operated valve being in an open position to release compressed air load when said rotatable housing portion is rotating at less than a predetermined portion of operating rotational speed and said valve moving to a closed position when said predetermined portion of operating rotational speed is reached by said rotatable housing portion.

8. A rotary device as claimed in claim 7, wherein said start-up load reducing means includes a further centrifugally operated valve in said rotatable housing portion, said centrifugally operated valves being in a gas flow path between said rotor chamber and ambient atmosphere, each of said centrifugally operated valves including:

a ball mounted in said rotatable housing portion, a spring in said rotatable housing portion biasing said ball radially inwardly relative to said rotatable housing portion, and a valve seat positioned radially outwardly from said ball against which said ball seats when centrifugal force on said ball as a result of rotation of said rotatable housing portion overcomes biasing force of said spring.

9. A rotary device, comprising:

a power transmitting shaft;

a stationary housing;

a rotatable housing portion connected to said power transmitting shaft and rotationally connected to said stationary housing for rotation about a first axis, portions of said rotatable housing forming a rotor chamber;

a rotor mounted in said rotor chamber and rotationally movable in said rotor chamber about a second axis distinct from said first axis but parallel thereto;

a stationary shaft connected between said stationary housing and said rotatable housing portion and fixed with respect to said stationary housing, said rotor being mounted for rotation on said stationary shaft;

an arrangement of valves mounted at said rotor chamber for controlling movement of gas into and out of said rotor chamber so that a first portion of said rotor chamber is operable as a first compressing stage and a second portion of said rotor chamber is operable as a second compressing stage; and an inter-cooler connected in a gas flow path between said first compensating stage and said second compressing stage and operable to cool compressed gas after a first stage compression.

10. A rotary device, comprising:

a power transmitting shaft;

a stationary housing;

a rotatable housing portion connected to said power transmitting shaft and rotationally connected to said stationary housing for rotation about a first axis, portions of said rotatable housing forming a rotor chamber; said rotatable housing portion comprising:

a flange gear assembly having air inlet valves, a rotor housing encircling said rotor, a valve plate having air outlet valves, and a seal housing, all connected together to rotate as a unit;

a rotor mounted in said rotor chamber and rotationally movable in said rotor chamber about a second axis distinct from said first axis but parallel thereto; and a stationary shaft connected between said stationary housing and said rotatable housing portion and fixed with respect to said stationary housing, said rotor being mounted for rotation on said stationary shaft.

11. A rotary device as claimed in claim 10, further comprising:

an outlet chamber in said seal housing defining a chamber at an outlet side of said rotor chamber for receiving compressed gas.

12. A rotary device, comprising:

a power transmitting shaft;

a stationary housing;

a rotatable housing portion connected to said power transmitting shaft and rotationally connected to said stationary housing for rotation about a first axis, portions of said rotatable housing forming a rotor chamber;

a rotor mounted in said rotor chamber and rotationally movable in said rotor chamber about a second axis distinct from said first axis but parallel thereto;

a stationary shaft connected between said stationary housing and said rotatable housing portion and fixed with respect to said stationary housing, said rotor being mounted for rotation on said stationary shaft; and a muffler mounted on said rotatable housing portion at an inlet for gas.

13. A rotary device, comprising:

a stationary housing portion;

a shaft fixed in said stationary housing portion, said shaft having at least first and second portions lying on distinct parallel axes;

a rotatable housing portion mounted for rotation on said stationary housing portion and on said first portion of said shaft, said rotatable housing portion defining a rotor chamber;

a ring gear in said rotatable housing portion;

a rotor in said rotor chamber of said rotatable housing portion and rotatably mounted on said second portion of said shaft, said rotor including a pinion gear encircling said second portion of said shaft and freely rotatable on said shaft, said pinion gear engaging said ring gear and said rotor including an outrigger sleever extending along said shaft and encircling said shaft from said rotor to at least said pinion gear; and first and second bearing assemblies mounted to enable said rotor to rotate, said first and second bearing assemblies being on either side of said pinion gear.

* * * * *